US009989073B2

(12) United States Patent
Hwang et al.

(10) Patent No.: US 9,989,073 B2
(45) Date of Patent: Jun. 5, 2018

(54) CENTRIFUGAL FAN

(71) Applicant: LG Electronics Inc., Seoul (KR)

(72) Inventors: Bonchang Hwang, Seoul (KR); Beomsoo Seo, Seoul (KR); Jihye Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 322 days.

(21) Appl. No.: 15/003,231

(22) Filed: Jan. 21, 2016

(65) Prior Publication Data

US 2016/0215793 A1 Jul. 28, 2016

(30) Foreign Application Priority Data

Jan. 22, 2015 (KR) ..... 10-2015-0010636

(51) Int. Cl.
*F04D 29/28* (2006.01)
*F04D 29/66* (2006.01)
*F04D 29/68* (2006.01)

(52) U.S. Cl.
CPC ..... *F04D 29/666* (2013.01); *F04D 29/281* (2013.01); *F04D 29/667* (2013.01); *F04D 29/681* (2013.01)

(58) Field of Classification Search
CPC .... F04D 29/281; F04D 29/667; F04D 29/666; F04D 29/681
See application file for complete search history.

(56) References Cited

U.S. PATENT DOCUMENTS 4,664,592 A * 5/1987 Grzina ..... F04D 29/2266 415/171.1
4,874,293 A * 10/1989 Gutzwiller ..... F04D 29/281 416/184
2006/0127211 A1* 6/2006 Walker ..... F04D 29/167 415/98
2007/0116561 A1* 5/2007 Hill ..... F04D 29/281 415/206
2009/0255654 A1* 10/2009 Zheng ..... F04D 29/162 165/122
2011/0211963 A1* 9/2011 Bohl ..... F04D 29/162 416/179

FOREIGN PATENT DOCUMENTS

EP 2363609 A1 9/2011
EP 2 218 917 B1 4/2013
JP 2001-173595 A 6/2001
JP 2001-263294 A 9/2001
JP 2008-223741 A 9/2008

* cited by examiner

*Primary Examiner* — Igor Kershteyn
(74) *Attorney, Agent, or Firm* — Birch, Stewart, Kolasch & Birch, LLP

(57) ABSTRACT

A centrifugal fan having improved efficiency and noise reduction includes a hub configured to have a central part combined with a rotary shaft, a shroud spaced apart from the hub, and a plurality of blades provided between the hub and the shroud. The shroud includes outer circumferential parts each connecting the trailing edges of a plurality of respective adjacent blades. Each outer circumferential part is asymmetrically formed based on the center of the outer circumferential part.

20 Claims, 2 Drawing Sheets

CENTRIFUGAL FAN

CROSS-REFERENCE TO RELATED APPLICATION

This application claims the benefit under 35 U.S.C. § 119(a) to Patent Application No. 10-2015-0010636, filed in the Republic of Korea on Jan. 22, 2015, the entire contents of which are hereby incorporated by reference.

BACKGROUND OF THE INVENTION

Field of the Invention

The present invention relates to a centrifugal fan and, more particularly, to a centrifugal fan having improved efficiency and noise.

Discussion of the Related Art

In general, a blower fan is used as a means for forcedly sending air using the rotary power of an impeller or rotor and is widely used in refrigerators, air-conditioners, and cleaners. In particular, the blower fan is divided into an axial flow fan, a sirocco fan, and a centrifugal fan depending on a method of sucking and discharging air or a shape thereof.

From among them, the centrifugal fan adopts a method of introducing air in the axial direction of the centrifugal fan and radially discharging the air through the side part of the centrifugal fan. The centrifugal fan does not require a duct because air is naturally introduced into the centrifugal fan and externally discharged, and is widely used in ceiling-attachment type air-conditioners, that is, relatively large products.

In such a centrifugal fan, blades are connected between a shroud into which air is introduced and a hub to which a rotary shaft is connected through welding or assembly. When the blade is rotated, a pressure difference is generated between the positive pressure surface and negative pressure surface of the blade. Accordingly, there are problems in that efficiency is reduced and noise is generated because a vortex is generated.

SUMMARY OF THE INVENTION

An object of the present invention is to provide a centrifugal fan capable of minimizing the generation of a vortex attributable to a pressure difference between the positive pressure surface and negative pressure surface of a blade.

Another object of the present invention is to provide a centrifugal fan having improved efficiency and noise by improving the shape of a shroud.

Objects to be achieved by the present invention are not limited to the aforementioned objects, and those skilled in the art will evidently appreciate other objects that have not been described from the following description.

A centrifugal fan in accordance with an embodiment of the present invention includes a hub configured to have a central part combined with a rotary shaft, a shroud spaced apart from the hub, and a plurality of blades provided between the hub and the shroud. The shroud includes outer circumferential parts each connecting the trailing edges of a plurality of respective adjacent blades, and each outer circumferential part is asymmetrically formed based on the center of the outer circumferential part.

The details of other embodiments are included in the detailed description and drawings.

The centrifugal fan according to an embodiment of the present invention may have one or more of the following advantages.

First, there is an advantage in that efficiency and noise are improved because the outer circumference of the shroud is asymmetrically formed.

Second, there is an advantage in that the generation of a vortex is minimized because a space on the pressure surface side of the blade is greater than that on the negative pressure surface side of the blade.

Third, there is an advantage in that the shroud and the blades can be coupled without a complicated processing or process because part of the outer circumference of the shroud is protruded so that it becomes distant from the side of the hub and a specific section of a portion connected to the trailing edge of a blade is formed in parallel to the hub.

Fourth, there is an advantage in that the stiffness of the shroud is maintained even under the pressure of discharged air because part of the outer circumference of the shroud is protruded so that it becomes distant from the side of the hub, part of the protruded part has a specific height, and air is smoothly discharged.

Advantages of the present invention are not limited to the aforementioned advantages, and those skilled in the art will evidently appreciate other advantages that have not been described from the claims.

DETAILED DESCRIPTION OF THE EMBODIMENTS

The merits and characteristics of the present invention and a method for achieving the merits and characteristics will become more apparent from embodiments described in detail later in conjunction with the accompanying drawings. However, the present invention is not limited to the disclosed embodiments, but may be implemented in various different ways. The embodiments are provided to only complete the disclosure of the present invention and to allow those skilled in the art to understand the category of the present invention. The present invention is defined by the category of the claims. The same reference numbers will be used to refer to the same or similar parts throughout the drawings.

A centrifugal fan in accordance with embodiments of the present invention is described with reference to the accompanying drawings.

Figure 1:
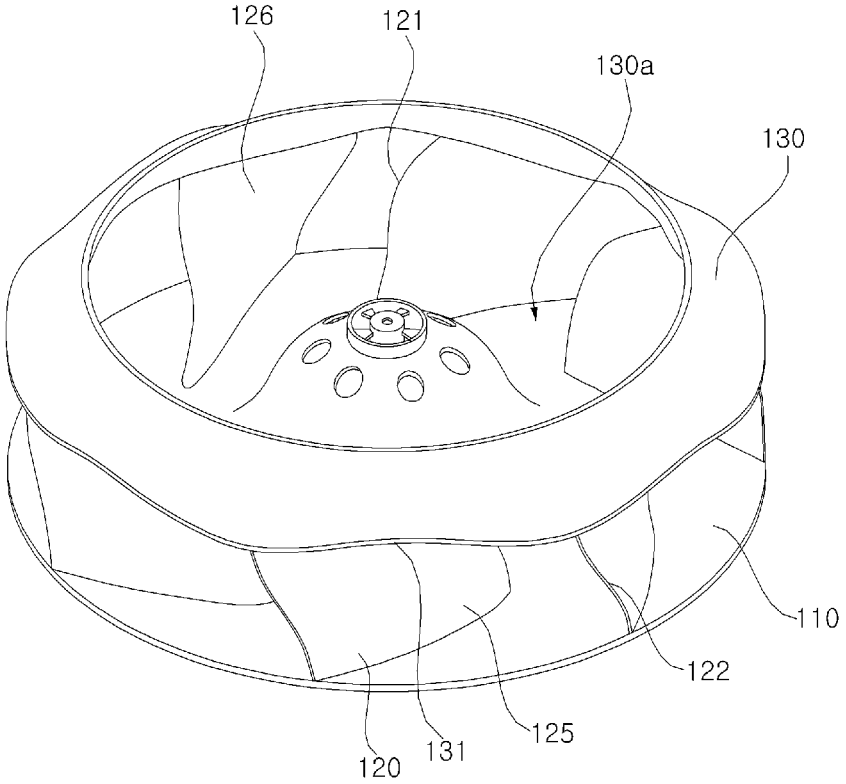
FIG. 1 is a perspective view of a centrifugal fan in accordance with an embodiment of the present invention.
Figure 2:
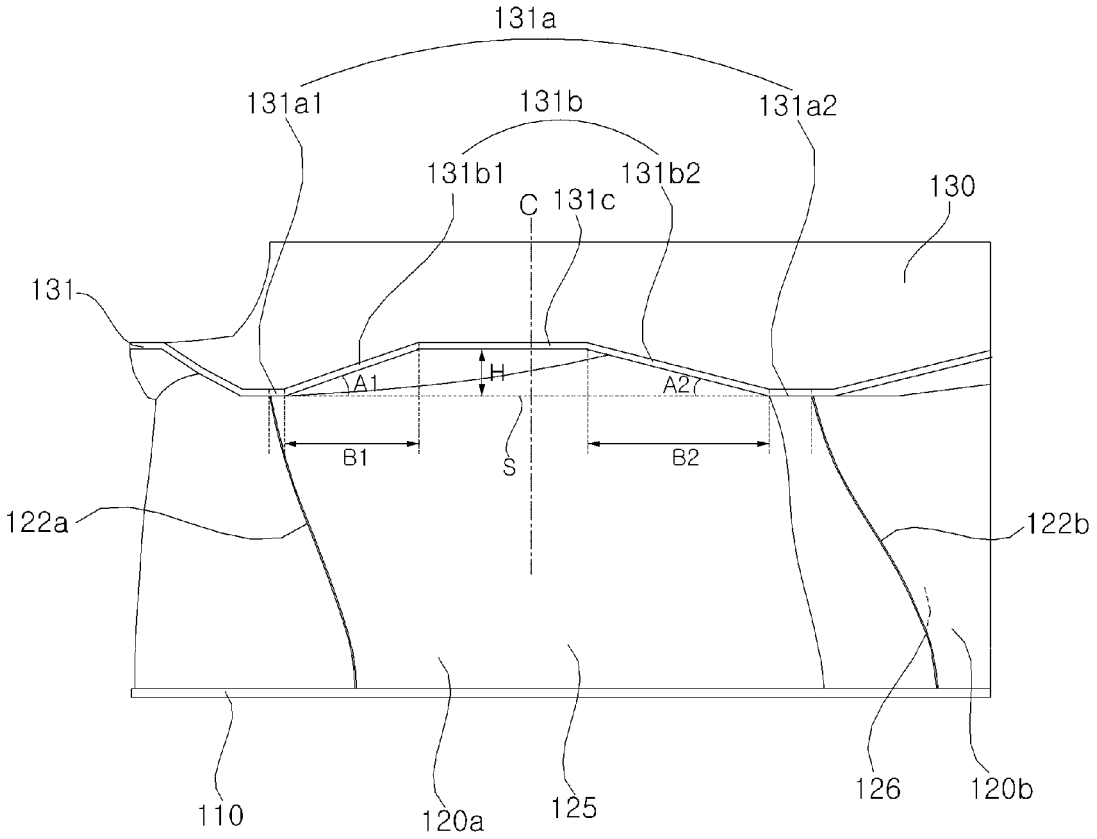
FIG. 2 is a partial side view of the centrifugal fan illustrated in FIG. 1.

FIG. 1 is a perspective view of a centrifugal fan in accordance with an embodiment of the present invention, and FIG. 2 is a partial side view of the centrifugal fan illustrated in FIG. 1.

The centrifugal fan in accordance with an embodiment of the present invention includes a hub 110 configured to have a central part thereof combined with a rotary shaft, a shroud 130 spaced apart from the hub 110, and a plurality of blades 120 provided between the hub 110 and the shroud 130.

The hub 110 is formed in a circular plate form and configured to have the central part thereof combined with the rotary shaft (not illustrated). The central part of the hub 110 may be protruded toward the shroud 130 for the combination with the rotary shaft and for the flow of air in a radial direction. The plurality of blades 120 is combined with a top surface of the hub 110.

The plurality of blades 120 is provided between the hub 110 and the shroud 130. The bottom of each of the blades 120 is combined with the top surface of the hub 110, and the top of each of the blades 120 is combined with a bottom surface of the shroud 130. The plurality of blades 120 is spaced apart from each other in a circumferential direction. The cross section of the blade 120 in a horizontal direction may have an airfoil shape.

A side of the blade 120 into which air is introduced is called a leading edge 121, and a side of the blade 120 from which air is discharged is called a trailing edge 122. Furthermore, a surface of the blade 120 in a rotary direction is called a pressure surface 125, and a surface in a direction opposite the rotary direction is called a negative pressure surface 126. In FIG. 1, the rotary direction of the blade 120 is a counterclockwise direction. High pressure is formed in the pressure surface 125 of the blade 120, and low pressure is formed in the negative pressure surface 126 of the blade 120.

The shroud 130 is disposed over the hub 110 and spaced apart from the hub 110. The shroud 130 includes an orifice 130*a* formed in a ring shape and configured to have air introduced into the center of the orifice. The shroud 130 may be configured to have a smaller inside diameter toward an upper part in which the orifice 130*a* is formed.

Referring to FIG. 2, the shroud 130 includes an outer circumferential part 131 connecting the trailing edges 122*a* and 122*b* of a plurality of adjacent blades 120*a* and 120*b*.

Hereinafter, a plurality of adjacent blades is called a first blade 120*a* and a second blade 120*b*, for example, and the second blade 120*b* has been illustrated as being spaced apart from the first blade 120*a* in the rotary direction.

The outer circumferential part 131 is part of the shroud 130 that connects the first trailing edge 122*a* of the first blade 120*a* and the second trailing edge 122*b* of the second blade 120*b*.

The outer circumferential part 131 is asymmetrically formed on the basis of a center line C thereof. The center line C of the outer circumferential part 131 is a vertical line placed at the center between a point at which the outer circumferential part 131 is connected to the first trailing edge 122*a* and a point at which the outer circumferential part 131 is connected to the second trailing edge 122*b*.

The outer circumferential part 131 is protruded in a direction opposite the hub 110 based on the reference line S, that is, a line that connects the points at which the outer circumferential part 131 is connected to the plurality of trailing edges 122*a* and 122*b* in a circumferential direction. The reference line S is a line that connects the point at which the outer circumferential part 131 and the first trailing edge 122*a* are connected and the point at which the outer circumferential part 131 and the second trailing edge 122*b* are connected in the circumferential direction. The reference line S may be present in a surface parallel to a surface formed by the outer circumference of the hub 110. The reference line S is formed in an arc shape when being seen at the top such that a circle is formed by connecting the reference lines S between all the blades 120.

The outer circumferential part 131 is protruded toward the upper side, that is, a direction opposite the hub 110 based on the reference line S, so that a space is formed between the outer circumferential part 131 and the reference line S. The outer circumferential part 131 is configured to rise from the first trailing edge 122*a* so that it becomes distant from the hub 110 and then to fall to meet the second trailing edge 122*b*. At least one point of the outer circumferential part 131 has a specific height H from the reference line S.

The outer circumferential part 131 includes a discontinuity point where a direction of the outer circumferential part abruptly changes. The outer circumferential part 131 is discontinuously formed to be asymmetrically formed, be protruded toward the upper side, or form the space between the outer circumferential part 131 and the reference line S. The discontinuity point is located between the trailing edge 122*a* of the first blade 120*a* and the trailing edge 122*b* of the second blade 120*b*.

The outer circumferential part 131 includes a joint part 131*a*, that is, a part aligned with the reference line S in a specific interval from the point at which the outer circumferential part 131 is connected to the trailing edge 122*a*, 122*b*, and a tilt part 131*b*, that is, a part that is inclined from the reference line S to a direction opposite the hub 110 and then extended.

The joint part 131*a* is aligned with the reference line S from a point at which the joint part 131*a* is connected to the trailing edge 122*a*, 122*b*. In this case, what the joint part 131*a* is aligned with the reference line S means is that the joint part 131*a* is disposed on the same plane as a plane formed by the reference line S. That is, the joint part 131*a* is aligned with the reference line S when being seen from the reference line S.

Because the outer circumference of the shroud 130 is circular, an end of the joint part 131*a* in the circumferential direction is circular, and thus the joint part 131*a* is formed in an arc shape when being seen at the top.

The joint part 131*a* is formed in parallel to a surface formed by the outer circumference of the hub 110 and maintains a specific interval from the outer circumference of the hub 110.

The joint part 131*a* is formed regardless of a change in the height so that the top of the blade 120 and the shroud 130 are combined without a complicated processing or process.

The joint part 131*a* includes a pressure surface-side joint part 131*a*1 disposed on the side of the pressure surface 125 of the first blade 120*a* and a negative pressure surface-side joint part 131*a*2 disposed on the side of the negative pressure surface 126 of the second blade 120*b*. The pressure surface-side joint part 131*a*1 and the negative pressure surface-side joint part 131*a*2 are connected by a single arc when being seen at the top.

The tilt part 131*b* is extended from the joint part 131*a* and is inclined from the reference line S to a direction opposite the hub 110. The tilt part 131*b* is inclined from the reference line S so that a space is formed between the tilt part 131*b* and the reference line S.

The tilt part 131*b* includes a pressure surface-side tilt part 131*b*1, that is, a part that is inclined from the pressure surface 125 of the blade 120 and extended, and a negative pressure surface-side tilt part 131*b*2, that is, a part that is inclined from the negative pressure surface 126 of the blade 120 and extended.

The pressure surface-side tilt part 131*b*1 is extended and inclined from the pressure surface 125 of the first blade 120*a* to the direction of the negative pressure surface 126 of the second blade 120*b*. The negative pressure surface-side tilt part 131*b*2 is extended and inclined from the negative pressure surface 126 of the second blade 120*b* and to the direction of the pressure surface 125 of the first blade 120*a*.

The pressure surface-side tilt part 131*b*1 is extended and inclined from the pressure surface-side joint part 131*a*1, and the negative pressure surface-side tilt part 131*b*2 is extended and inclined from the negative pressure surface-side joint part 131*a*2.

Assuming that a length of the pressure surface-side tilt part 131*b*1 projected onto the reference line S is called a pressure surface-side length B1, a length of the negative pressure surface-side tilt part 131*b*2 projected onto the reference line S is called a negative pressure-side length B2, an angle formed by the pressure surface-side tilt part 131*b*1 and the reference line S is called a pressure surface-side tilt angle A1, and an angle formed by the negative pressure surface-side tilt part 131*b*2 and the reference line S is called a negative pressure surface-side tilt angle A2, various conditions below are set in order for the outer circumferential part 131 to be asymmetrically formed based on the center line C.

$A1>A2$ and $B1=B2$ Condition 1:

$A1=A2$ and $B1<B2$ Condition 2:

$A1>A2$ and $B1<B2$ Condition 3:

That is, the pressure surface-side tilt angle A1 may be greater than the negative pressure surface-side tilt angle A2. The pressure surface-side length B1 may be shorter than the negative pressure surface-side length B2.

The pressure surface-side length B1 may be shorter than the negative pressure surface-side length B2 and the pressure surface-side tilt angle A1 may be greater than the negative pressure surface-side tilt angle A2 so that the condition 3 is satisfied.

A space on the pressure surface, that is, a space on the side of the pressure surface 125 of the first blade 120*a* based on the center line C of the outer circumferential part 131, may be greater than a space on the negative pressure surface, that is, a space on the side of the negative pressure surface 126 of the second blade 120*b*, when a space between the outer circumferential part 131 and the reference line S is divided by the space on the pressure surface and the space on the negative pressure surface. The tilt part 131*b* may be formed to satisfy one of the conditions 1 to 3 so that the space on the pressure surface is greater than the space on the negative pressure surface.

In some embodiments, the joint part 131*a* may be omitted, and the tilt part 131*b* may be formed from the point at which the outer circumferential part 131 and the trailing edge 122*a*, 122*b* are connected. That is, the pressure surface-side tilt part 131*b*1 may be extended and inclined from a point at which the pressure surface-side tilt part 131*b*1 and the first trailing edge 122*a* are connected, and the negative pressure surface-side tilt part 131*b*2 may be extended and inclined from a point at which the negative pressure surface-side tilt part 131*b*2 and the second trailing edge 122*b* are connected.

The outer circumferential part 131 may include a connection part 131*c* that connects the pressure surface-side tilt part 131*b*1 and the negative pressure surface-side tilt part 131*b*2.

A point at which the connection part 131*c* connects to the pressure surface-side tilt part 131*b*1 may be considered a first discontinuity point where a direction of the outer circumferential part abruptly changes. Similarly, a point at which the connection part 131*c* connects to the negative pressure surface-side tilt part 131*b*2 may be considered a second discontinuity point where a direction of the outer circumferential part abruptly changes. Alternatively, the pressure surface-side tilt part 131*b*1 may connect directly to the negative pressure surface-side tilt part 131*b*2 at a discontinuity point where a direction of the outer circumferential part abruptly changes.

The connection part 131*c* may be formed so that it is horizontal to the reference line S. A specific height H may be formed between the connection part 131*c* and the reference line S.

The connection part 131*c* may be disposed on a plane horizontal to a plane formed by the reference line S so that air is smoothly discharged and the stiffness of the shroud 130 is maintained even under pressure attributable to the discharged air. The center of the connection part 131*c* may be disposed in the direction of the pressure surface 125 of the first blade 120*a* based on the center line C of the outer circumferential part 131.

Although some exemplary embodiments of the present invention have been illustrated and described, the present invention is not limited to the aforementioned specific embodiments, and those skilled in the art to which the present invention pertains may modify the embodiments in various ways without departing from the gist of the present invention which is claimed in the claims. The modified embodiments should not be interpreted individually from the technical spirit or prospect of the present invention.

What is claimed is:

1. A centrifugal fan, comprising:

a hub having a central part configured to be combined with a rotary shaft;

a shroud spaced apart from the hub; and a plurality of blades provided between the hub and the shroud, the plurality of blades including a first blade, the plurality of blades further including a second blade adjacent to the first blade, wherein an outer periphery of the shroud includes an outer circumferential part interconnecting a trailing edge of the first blade and a trailing edge of the second blade, wherein the outer circumferential part is asymmetrically formed about a center of the outer circumferential part between the trailing edge of the first blade and the trailing edge of the second blade, and wherein the outer circumferential part includes a discontinuity point where a direction of the outer circumferential part changes, the discontinuity point being located between the trailing edge of the first blade and the trailing edge of the second blade.

2. The centrifugal fan of claim 1, wherein a reference line is defined in a circumferential direction that connects a first point at which the outer circumferential part is connected to the trailing edge of the first blade and a second point at which the outer circumferential part is connected to the trailing edge of the second blade, and wherein a portion of the outer circumferential part that is between the first point and the second point protrudes in a direction away from the reference line and the hub.

3. The centrifugal fan of claim 2, wherein the outer circumferential part comprises a first joint part aligned with the reference line and located at the first point at which the outer circumferential part is connected to the trailing edge of the first blade.

4. The centrifugal fan of claim 3, wherein the outer circumferential part comprises a second joint part aligned with the reference line and located at the second point at which the outer circumferential part is connected to the trailing edge of the second blade.

5. The centrifugal fan of claim 2, wherein the outer circumferential part comprises a tilt part that is inclined with respect to the reference line, and that extends from the reference line in a direction away from the reference line and the hub.

6. The centrifugal fan of claim 5, wherein the tilt part comprises:

a pressure surface-side tilt part inclined and extended from a pressure surface of the first blade, and a negative pressure surface-side tilt part inclined and extended from a negative pressure surface of the second blade.

7. The centrifugal fan of claim 6, wherein the outer circumferential part further comprises a connection part connecting the pressure surface-side tilt part and the negative pressure surface-side tilt part.

8. The centrifugal fan of claim 7, wherein the connection part extends parallel to the reference line.

9. The centrifugal fan of claim 6, wherein a pressure surface-side length that is a length of the pressure surface-side tilt part projected onto the reference line is shorter than a negative pressure surface-side length that is a length of the negative pressure surface-side tilt part projected onto the reference line.

10. The centrifugal fan of claim 6, wherein a pressure surface-side tilt angle formed between the pressure surface-side tilt part and the reference line is greater than a negative pressure surface-side tilt angle formed between the negative pressure surface-side tilt part and the reference line.

11. The centrifugal fan of claim 2, wherein a space is provided between the outer circumferential part and the reference line, the space comprising:

a first space that is located between a center of the outer circumferential part and a pressure surface side of the first blade; and a second space that is located between the center of the outer circumferential part and a negative pressure surface side of the second blade, wherein the first space on the pressure surface side is greater than the space on the negative pressure surface side.

12. A centrifugal fan, comprising:

a hub having a central part configured to be combined with a rotary shaft;

a shroud spaced apart from the hub; and a plurality of blades provided between the hub and the shroud, the plurality of blades including a first blade, the plurality of blades further including a second blade adjacent to the first blade, wherein an outer periphery of the shroud includes an outer circumferential part interconnecting a trailing edge of the first blade and a trailing edge of the second blade, wherein the outer circumferential part is asymmetrically formed about a center of the outer circumferential part between the trailing edge of the first blade and the trailing edge of the second blade, wherein a reference line is defined in a circumferential direction that connects a first point at which the outer circumferential part is connected to the trailing edge of the first blade and a second point at which the outer circumferential part is connected to the trailing edge of the second blade, wherein a space is provided between the outer circumferential part and the reference line, the space comprising a first space that is located between a center of the outer circumferential part and a pressure surface side of the first blade, and a second space that is located between the center of the outer circumferential part and a negative pressure surface side of the second blade, wherein the outer circumferential part at the first space includes a pressure surface-side tilt part that is inclined with respect to the reference line, and that extends in a direction away from the pressure surface side of the first blade and away from the reference line and the hub, and wherein the first space on the pressure surface side is greater than the space on the negative pressure surface side.

13. The centrifugal fan of claim 12, wherein the outer circumferential part at the second space includes a negative pressure surface-side tilt part that is inclined with respect to the reference line, and that extends in a direction away from the negative pressure surface side of the second blade and away from the reference line and the hub.

14. The centrifugal fan of claim 13, wherein a pressure surface-side length that is a length of the pressure surface-side tilt part projected onto the reference line is shorter than a negative pressure surface-side length that is a length of the negative pressure surface-side tilt part projected onto the reference line.

15. The centrifugal fan of claim 14, wherein a pressure surface-side tilt angle formed between the pressure surface-side tilt part and the reference line is greater than a negative pressure surface-side tilt angle formed between the negative pressure surface-side tilt part and the reference line.

16. The centrifugal fan of claim 15, wherein the outer circumferential part further comprises a connection part connecting the pressure surface-side tilt part and the negative pressure surface-side tilt part.

17. The centrifugal fan of claim 16, wherein the connection part extends parallel to the reference line.

18. The centrifugal fan of claim 13, wherein a pressure surface-side tilt angle formed between the pressure surface-side tilt part and the reference line is greater than a negative pressure surface-side tilt angle formed between the negative pressure surface-side tilt part and the reference line.

19. The centrifugal fan of claim 13, wherein the outer circumferential part further comprises a connection part connecting the pressure surface-side tilt part and the negative pressure surface-side tilt part.

20. The centrifugal fan of claim 19, wherein the connection part extends parallel to the reference line.

* * * * *